United States Patent [19]

van Deuren

[11] 4,293,295

[45] Oct. 6, 1981

[54] PELLETING PRESS

[75] Inventor: Franciscus van Deuren, Boxtel, Netherlands

[73] Assignee: Simon-Heesen B.V., Boxtel, Netherlands

[21] Appl. No.: 98,361

[22] Filed: Nov. 28, 1979

Related U.S. Application Data

[62] Division of Ser. No. 901,825, May 1, 1978, abandoned.

[30] Foreign Application Priority Data

May 11, 1977 [NL] Netherlands ..... 7705231

[51] Int. Cl.[3] ..... B28B 3/20

[52] U.S. Cl. ..... 425/331; 425/314

[58] Field of Search ..... 425/331, 314, 309; 74/661, 722, 665 R, 665 A, 665 B; 264/138

[56] References Cited

U.S. PATENT DOCUMENTS

| | | | |
|---|---|---|---|
| 807,048 | 12/1905 | Ronan | 74/722 |
| 847,440 | 3/1907 | Rivett | 74/722 |
| 2,771,790 | 11/1956 | Munschauer | 74/665 |
| 3,534,634 | 10/1970 | Kawanami | 74/722 |
| 3,679,343 | 7/1972 | Gilman | 425/314 |
| 3,723,042 | 3/1973 | Raydt | 425/331 |
| 3,950,120 | 4/1976 | Jones et al. | 425/314 |
| 4,029,459 | 6/1977 | Schmiedeke | 425/335 |

FOREIGN PATENT DOCUMENTS

| | | | |
|---|---|---|---|
| 1500473 | 6/1969 | Fed. Rep. of Germany | 74/661 |
| 216932 | 7/1968 | U.S.S.R. | 425/7 |

*Primary Examiner*—Jay H. Woo

*Attorney, Agent, or Firm*—Norris & Bateman

[57] ABSTRACT

A pelletizing press wherein an annular die having material extrusion bores therethrough has its inner periphery operatively engaging freely rotatable pelletizing rollers. The die is carried by a tubular rotor and the tubular rotor is driven by at least two motors, each drive connected separately to a common endless flexible driving member also drive connected to said die.

9 Claims, 2 Drawing Figures

PELLETING PRESS

This is a division of Ser. No. 901,825 filed May 1, 1978 now abandoned.

This invention concerns a pelletising press of the kind comprising an annular die having bores therethrough which is adapted to be rotated about its central axis whereby material introduced into the centre of the die is extruded through said bores by the action of one or more freely rotatable pelletising rollers which engage with the inner peripheral surface of the annular die and which are carried on a support structure connected with a stationary shaft, the die being fixed to a tubular rotor which is rotatably mounted on said stationary shaft.

In a conventional pelletising press of this kind, a single large driving motor is provided for rotating the die through a suitable transmission system.

During use of a pelletising press of this kind, there is a danger of the press jamming, caused for example by the introduction of a stone or other hard object between one of the pelletising rollers and the internal periphery of the die.

For this reason the stationary shaft is arranged to be rotated against brake means so that it can be turned by the die in the event of such jamming to operate a switch to stop the motor.

The present invention is based upon an appreciation of the possibility of providing two or more relatively small motors instead of one large motor. The use of two motors provides certain advantages; for example, the rotor which supports the die can be more evenly loaded during driving, and furthermore the cost of the two smaller motors and ancillary equipment can be less than that of a single large motor with its ancillary equipment. Additionally, in the conventional press when the motor is stopped the inertia of its rotating parts must be dissipated in the transmission system, and in some cases the total inertia to be absorbed under these circumstances may be reduced by the provision of two relatively small motors.

According to the present invention, there is provided a pelletising press comprising a rotatably mounted annular die having material extrusion bores therethrough, at least one freely rotatable pelletising roller mounted on a fixed axis and disposed in operative association with the inner periphery of said annular die whereby to extrude material through the rotating die, and means for rotating said annular die including at least two motors each drive connected separately to a common endless flexible driving member also drive connected to said die.

The invention will be further apparent from the following description with reference to the accompanying drawings which shows, by way of example only, in diagrammatic form, one kind of pelletising press embodying the invention.

Of the drawings—

Figure 1:
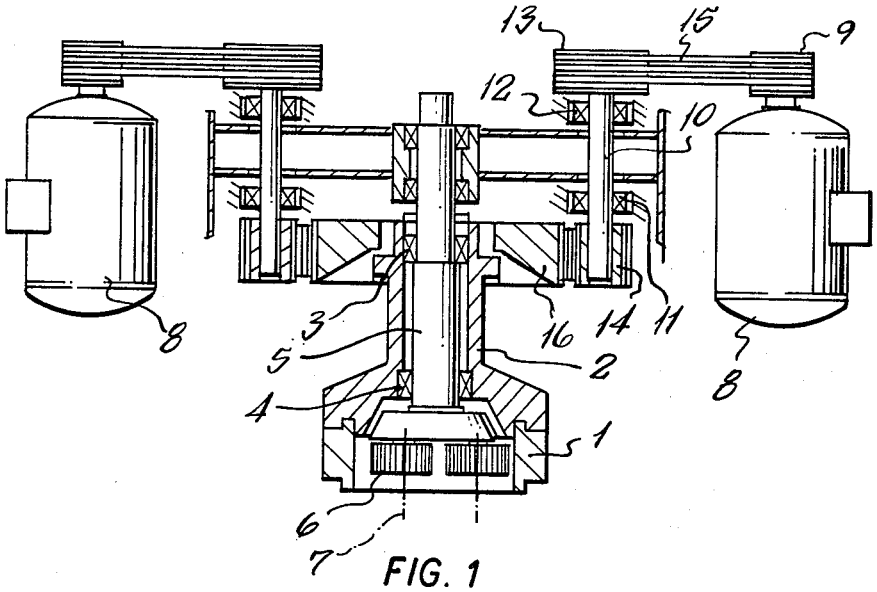
FIG. 1 shows a partially sectioned plan view of the press.
Figure 2:
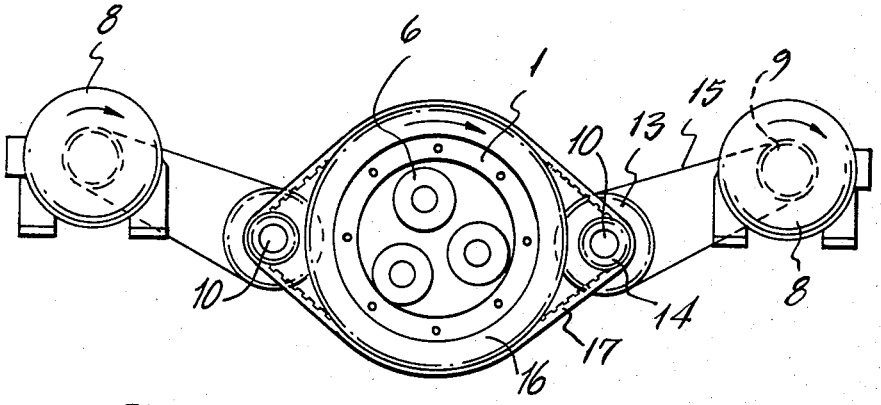
FIG. 2 shows a front elevation of the press of FIG. 1

Referring now to the drawings, it will be seen that the pelletising press, in known manner, consists of an annular die 1 which is secured to one end of a tubular rotor 2. The rotor 2 is mounted by bearings 3 and 4 on a normally stationary shaft 5 which carries a plate mounting a plurality of freely rotatable pelletising rollers 6.

The die 1 is provided with bores therethrough and each pelletising roller 6 is mounted to rotate about a fixed axis and is disposed in operative association with the periphery of the rotating annular die 1 as shown in the drawings whereby to extrude material fed to the interior of the die, outwardly through the bores, thus to pelletise it. A die and roller arrangement of this kind is disclosed in U.S. Pat. No. 3,950,120 issued Apr. 13, 1976 to Jones et al. In known manner, the normally stationary shaft 5 is prevented from rotation by means of a braking mechanism (not shown) but which can allow it to be carried with the die 1 in the event of jamming of the press as can happen if a stone or other hard object is introduced between one of the pelletising rollers 6 and the internal periphery of the die 1. Rotation of the normally stationary shaft in this manner actuates a switch to cut the supply of power to the drive.

In accordance with the invention, two drive motors 8 are provided which are preferably of substantially equal power. Each motor 8 drives a V-belt pulley 9. The V-belt pulleys 9 drive individual shafts 10 mounted in bearings 11 and 12 and carrying V-belt pulleys 13 at one of their ends and toothed belt pulleys 14 at their other ends. The drive between the pulleys 9 and 13 is transmitted by V-belts 15.

A toothed belt pulley 16 is secured to the rotor 2 and connected by an endless toothed belt 17 with the two toothed belt pulleys 14.

Since the toothed belt 17 is driven at two different points it can have a much lower rating than would be necessary if it were driven by a single motor.

Preferably the axes of the tubular rotor 2 and each of the two pulleys 14 are arranged in a common plane whereby the toothed belt 17 exerts pure torque onto the pulley 16 and no forces which need to be absorbed by the bearings 3 and 4.

It will be appreciated that it is not intended to limit the invention to the above example only, many variations, such as might readily occur to one skilled in the art, being possible without departing from the scope thereof.

Thus for example, instead of providing a toothed belt to drive the rotor 2, a chain engaging suitable sprockets may be provided or indeed a number of V-belts may be used. In the event that V-belts are used the motors 8 may serve to drive the shafts 10 by way of a non-slip drive as, for example, by means of a toothed belt or chain.

Again, for example, the shafts 10 may be directly coupled to the output shafts of the motor 8 if the speed of the motors is sufficiently low and a slipping drive is used to connect the shafts 10 with the rotor 2. If a slipping drive is not used to connect the shafts 10 with the rotor 2 slipping clutch devices may be incorporated between the motors 8 and shafts 10.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A pelletising press comprising a rotatably mounted annular die having material extrusion bores therethrough, at least one freely rotatable pelletising roller mounted on a fixed axis and disposed in operative association with the inner periphery of said annular die whereby to extrude material through the rotating die, and means for rotating said annular die including at least two motors each drive connected separately to a common endless flexible driving member also drive connected to said die.

2. A pelletising press according to claim 1, wherein each said motor drives a toothed belt pulley and said die is provided with a toothed belt pulley, the toothed belt pulleys collectively being wrapped by a common toothed belt.

3. A pelletising press according to claim 2, wherein the axes of the three toothed belt pulleys lie in a common plane.

4. A pelletising press according to claim 3, wherein the toothed belt pulleys driven by said motors are arranged on opposite sides of the rotational axis of the die, and each of said two pulleys is connected to its respective motor by means of a driving member which slips if torque transmitted therethrough exceeds a predetermined amount.

5. A pelletising press according to claim 4, wherein each said driving member comprises at least one V-belt.

6. A pelletising press according to claim 1, wherein said two motors are of substantially equal driving power.

7. A pelletising press as defined in claim 1, wherein said means for rotating the die comprises drive modifying slip means responsive to predetermined torque being transmitted thereby.

8. A pelletising press comprising a tubular rotor, an annular die fixed to said rotor having a series of substantially radial extrusion bores therethrough, a plurality of freely rotatable pelletising rollers mounted to engage the inner periphery of said annular die, a coaxial pulley fixed to said rotor, a pair of motors disposed at opposite sides of said rotor, a pair of rotatably mounted shafts disposed intermediate the rotor and said motors, pulleys on said shafts, means drive connecting each motor individually to one of said shafts, and a common flexible endless belt passing around all of said pulleys.

9. The pelletising press defined in claim 8, wherein said endless flexible belt has non-slip connection with said pulleys, and said means connecting the motors to the shafts comprise V-belts adapted to slip when a predetermined torque transmission therethrough is attained.

* * * * *